US006293031B1

(12) United States Patent
Ringbom et al.

(10) Patent No.: US 6,293,031 B1
(45) Date of Patent: Sep. 25, 2001

(54) METHOD AND APPARATUS FOR DRYING A COATED PAPER WEB OR THE LIKE

(75) Inventors: Knut Ringbom, Turku; Richard Solin, Kemlo, both of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/462,293

(22) PCT Filed: Jul. 3, 1998

(86) PCT No.: PCT/FI98/00567

§ 371 Date: Feb. 1, 2000

§ 102(e) Date: Feb. 1, 2000

(87) PCT Pub. No.: WO99/02773

PCT Pub. Date: Jan. 21, 1999

(30) Foreign Application Priority Data

Jul. 7, 1997 (FI) ..... 972878

(51) Int. Cl.[7] ..... F26B 7/00

(52) U.S. Cl. ..... 34/422; 34/445; 34/448; 34/461; 34/631; 34/633; 34/638; 34/640; 34/643

(58) Field of Search ..... 34/273, 274, 414, 34/419, 420, 422, 425, 445, 448, 460, 461, 114, 122, 621, 633, 638, 640, 643; 226/95, 96, 97; 101/416.1, 424.1, 487, 488

(56) References Cited

U.S. PATENT DOCUMENTS

| | | | | |
|---|---|---|---|---|
| 3,549,070 | | 12/1970 | Frost et al. . | |
| 4,848,633 | | 7/1989 | Hagen et al. . | |
| 5,230,165 | | 7/1993 | Beisswanger . | |
| 5,345,696 | * | 9/1994 | Bosoni | 34/638 |
| 5,634,402 | * | 6/1997 | Rudd et al. | 34/629 X |
| 5,636,450 | * | 6/1997 | Lizé | 226/97 X |
| 5,771,602 | | 6/1998 | Heikkila et al. . | |

* cited by examiner

*Primary Examiner*—Stephen Gravini
(74) *Attorney, Agent, or Firm*—Nixon & Vanderhye P.C.

(57) ABSTRACT

Method and apparatus for drying a coated paper web (W) or the like web. The apparatus (10) comprises sequentially in the running direction of the web—a turning device (16) arranged on the first side of the web and provided with blow nozzles (20), with which the running direction of the web to be dried is turned in a non-contacting way, and web drying devices (30, 30') arranged on the first and the second sides of the web, in which the web is dried in a non-contacting manner. The apparatus further comprises a counterpart (18) provided with overpressure nozzles (24), arranged on the second side of the web at the point of the turning device (16), for stabilizing the web run by means of blows generating a local overpressure between the web (W) and the carrier surfaces of the overpressure nozzles (24).

21 Claims, 3 Drawing Sheets

METHOD AND APPARATUS FOR DRYING A COATED PAPER WEB OR THE LIKE

This application is a 371 PCT /FI98/00567 filed Jul. 3, 1998 which claims priority from Finnish application 972 878 filed Jul. 7, 1997.

The present invention relates to a method and an apparatus for drying a coated paper web or the like.

From the U.S. Pat. Nos. 5,771,602 and 5,230,165, it has previously been known to turn a coated but still undried paper web or the like in a non-contacting way by blows generated by a turning device before the web is actually dried in a non-contacting way by airborne web-dryers arranged on both sides of the web.

From the U.S. Pat. No. 5,230,165, it is also per se known to arrange curved counterpart provided with underpressure nozzles against the turning device on the other side of the paper web. The purpose is to begin the drying of the paper web on both sides of the web already at the curved section of the web. The underpressure nozzles have a relatively limited drying capacity, as drying air is blown to flow principally in the direction of the web along the nozzle surface, utilizing the Coanda effect. In the arrangements shown, the moist and still warm drying air blown from the underpressure nozzles is allowed to flow from the counterpart directly into the machine room surrounding the apparatus, which adversely increases moisture and heat in the machine room, in addition to the fact that wasting heat as such does not conform to principles of sound energy economy.

Due to the Coanda effect, a static underpressure zone is formed between the nozzles and the web in the nozzle area in the counterparts known per se, principally over the entire nozzle area. The aim is to use this underpressure to intensify the pushing effect of the turning device by means of suction in the counterpart area. Suction is used to spread the web outwards in order to stabilize the web on its curved course. However, regarding these arrangements provided with underpressure nozzles, there is a risk that the paper web, should it lacken for example due to tension variations, contacts the nozzles of the counterpart whereupon the coating is damaged and/or the web breaks.

SUMMARY OF THE INVENTION

The object of the present invention is thus to provide a new, improved method and an apparatus in which the drawbacks presented above have been minimized.

It especially is an object of the present invention to provide a method and an apparatus with which it is possible to achieve an improved runnability or controllability of a paper web or the like.

It is further an object of the invention to provide a method and an apparatus which make it possible to lead the paper web or the like more safely through a slot formed by the turning device and the counterpart.

A further object is to provide a method and an apparatus providing a larger drying capacity of the paper web than before, and thus save space in the machine room.

It is a further object to provide a method and an apparatus with which it is possible to decrease the moisture and thermal load in the machine room and thus simultaneously improve the energy economy of the process.

The in which the running direction of the paper web (W) to be dried is turned in a non-contacting way by using blows generated by blow nozzles of the turning device and by pad pressure thus generated;

The paper web is dried in a non-contacting way with drying devices.

The apparatus typically comprises a counterpart provided with overpressure nozzles, the counterpart being arranged at the curved turning device area on the opposite side of the paper web.

Overpressure nozzles refer here to nozzles the blows of which generate a web pushing power at all distances from the web. In the known arrangements described above, the starting point has been the reverse; in them, underpressure nozzles have been used for generating at a certain distance from the web a power opposite to the pushing power in order to spread the web. With the overpressure nozzles of the invention, it is possible to control the running of the web better and to ensure that the web stays apart from the nozzles.

In an advantageous arrangement of the invention, the counter-part may be provided with, for example, Float or Push nozzles disclosed in the applicant's U.S. Pat. No. 4,384,666. On the other hand, if desired, the counterpart may also be provided with simple impingment nozzles which include, for example, a perforated plate or one or more slots extending across the web, from which air is blown principally directly against the web.

The overpressure nozzles of the counterpart are advantageously arranged radially against the blow nozzles of the turning device, i.e. so that blows from the counterpart are directed against the paper web and against the blows from the turning device arranged on the first side of the web. Thus the blows, for example from Float overpressure nozzles, generate a local overpressure on both sides of the web between the paper web and the carrier surfaces of the nozzle, i.e. the nozzle surfaces; with this overpressure, the running of the paper web may be stabilized and the runnability and controllability of the web may be improved. Impingment nozzles provide the same result, although the pressure generated by the impingment nozzles generally is slightly lower than the pressure generated by overpressure nozzles of the Float type.

On the straight run of the paper web arranged after the turning section, i.e. in the drying section, floating nozzles on the opposite sides of the paper web are, however, arranged advantageously interlaced with each other so that the web travels in a sine-wave path between the nozzles arranged on both sides of the web, which allows an as smooth as possible web run. It is naturally possible that also part of the nozzles in the turning section of the web are arranged interlaced with each other.

In the turning section of the device, the running direction of the web may be turned even 20°–260°, typically 30°–160°.

The actual turning device of the invention, in which the running direction of the paper web may be turned 20°–260°, comprises typically 3–15 blow nozzles. The counterpart advantageously comprises the same number of overpressure nozzles, i.e. 3–15 nozzles. Also the blow nozzles of the actual turning device are preferably overpressure nozzles.

According to the invention, the pushing nozzles of both the turning device and the counterpart are principally so-called Float overpressure nozzles of the applicant. As the nozzles in the turning section additionally are arranged opposite to each other on both sides of the web, the pushing forces caused by the nozzle flows are directed against each other. This generates a local overpressure at the carrier surface areas of the nozzles on both sides of the web. The local overpressures arranged opposite to each other on both sides of the web have a stabilizing effect on the web run, and improve the runnability and controllability of the web, also in cases of disturbance. Thus the arrangement of the invention provides an optimal configuration of nozzles as to the control of the web.

With the arrangement of the invention, in which overpressure nozzles, such as Float nozzles, are used in the counterpart instead of underpressure nozzles known per se, such as Foil or Pull nozzles disclosed in the applicant's patent U.S. Pat. No. 4,247,993, for example the important advantage is achieved compared with the known technology, that it is considerably less probable that, due to tension variations, the paper web would contact the nozzles of the counterpart or the turning device, because the overpressure nozzle pushes the web away, while an underpressure nozzle is not necessarily always able to keep the web away from the nozzle surface.

The turning device of the invention is further advantageously provided with a control device, increasing the controllability of the turning device and making it possible to automatically control the distance between the turning device and the web, this control being based on the ratio between the supply air pressure of the turning device and the pad pressure. In addition, the pressures may be used for automatically calculating the tension of the web.

Thereby the control device typically comprises

- a pressure sensor arranged in the blow nozzles of the turning device for measuring the internal pressure $P_{SP}$ of the blow nozzle;
- a second pressure sensor arranged between the turning device and the paper web for measuring the pad pressure $P_{KL}$ between the turning device and the paper web; and
- a control element with which the values of the various pressure sensors are combined in order to calculate the distance H between the nozzle surface of the turning device and the paper web and/or in order to adjust it to a desired level.

For the calculation of web tension,

- a third pressure sensor arranged between the counterpart and the paper web for measuring the pressure $P_{VK}$ between the counterpart and the paper web additionally needed.

The distance H between the nozzle surface of the turning device and the paper web is, within the typical range of 0–30 mm, derived from the formula:

$$H = a\frac{P_{SP}}{P_{KL}} + b$$

in which

- H is the distance (mm) between the nozzle surface and the paper web;
- $P_{SP}$ is the internal pressure (Pa) of the blow nozzles;
- $P_{KL}$ is the is the pad pressure (Pa) of the turning device, i.e. the pressure between the turning device and the paper web, measured in the turning device in the free space between the nozzles;
- a is the amplification coefficient for the machine;
- b is the difference variable for the machine.

The pad pressure refers to overpressure in the turning device, generated into the turning device, as a box or a similar structure arranged around it restricts the discharge of blowing air from the turning device. With a certain turning device structure, the pad pressure is principally dependent on the amount of air led to the turning device, the pressure prevailing in the counterpart, and the tension of the web. The pad pressure is measured in the free space between the nozzles of the turning device.

The distance between the carrier surface of the nozzles and the paper web is generally controlled either by adjusting the operating speed of the blower blowing air to the blow nozzles of the turning device, or by a guide vane adjuster so that, by controlling the air supply in this way, also the nozzle pressure $P_{SP}$ of the blow nozzles, and thus also the distance of the web from the nozzles, is controlled.

The automatic adjustment of the distance between the carrier surface of the turning device nozzles and the paper web is in practice carried out so that the internal pressure $P_{SP}$ of the nozzle of the turning device and the pad pressure $P_{KL}$ between the paper web and the turning device are measured automatically by two pressure sensors, whereafter the distance of the web from the nozzle surface is automatically calculated with the help of the ratio between the internal pressure in the nozzle (nozzle pressure) and the pad pressure, using the above mentioned formula. When necessary, this ratio may be corrected by adjusting the supply of blowing air so that the distance of the web from the nozzle surface remains at a desired level. The adjustment may be automatic, in which case the aim is usually to maintain the distance constant by keeping the ratio between the nozzle pressure and pad pressure constant.

The web run may thus be corrected with the pressure adjustment, for example, in a case in which the paper web is drawn away from the nozzle surface due to the decrease in web tension. As the web tension decreases, the pad pressure of the turning device decreases and the ratio between the nozzle pressure $P_{SP}$ and the pad pressure $P_{KL}$ increases. By reducing the supply of air to the nozzles, for example, by reducing the operating speed of the blower or by adjusting the guide vanes, the nozzle pressure may thus be automatically reduced whereupon the ratio of the nozzle pressure and the pad pressure, and thus also the distance of the web from the nozzle surface, decreases.

Besides the web distance, also the paper web tension T may automatically be monitored on the basis of values from the pressure sensors, using the following formula $$T=C^*[P_{KL}(r+h)-k_{VK}P_{VK}(r+h)+Mv^2]$$

in which

- C is the amplification coefficient relating to the machine in question within the range of 0.7–1.4, typically 1.0;
- $P_{KL}$ is the pad pressure (Pa) for the turning device, i.e. the pressure between the turning device and the paper web, measured in the turning device in the free space between the nozzles;
- $P_{VK}$ is the pressure (Pa) in the counterpart, measured in the free space between the nozzles;
- $k_{VK}$ is a parameter constant machine in question within the range of 0.6–1, typically 0.8;
- r is the radius (m) of the turning device;
- h is the distance (m) between the nozzle surface of the turning device and the paper web;
- T is the tension (N/m) of the paper web;
- M is the grammage (kg/m$^2$) of the paper web;
- v is the speed (m/s) of the paper web.

The calculated tension value may be used for controlling the tension adjustment. A static pressure $P_{VK}$ deviating from the atmospheric pressure may be generated between the web and the counterpart, which is dependent on the running mode, and on the supply and discharge of air; this pressure may be above or below the atmospheric pressure, in which case it has to be taken into account when calculating the tension. It may be mentioned that the pressures given in this application generally refer to pressures in relation to the atmospheric pressure, unless stated otherwise.

The pressure in the counterpart also affects the pad pressure between the turning device and the web. By adjusting the pressure in the counterpart, within the range from over-pressure to underpressure, the web run may thus also be controlled from the counterpart side.

When desired, the overpressure nozzles of the counterpart, as well as the blow nozzles of the turning device, may be used for blowing hot air onto the paper web, the temperature of air being 100–450° C., preferably 150–400° C., and the speed of air 20–100 m/s, preferably 40–80 m/s so that the paper web may efficiently be dried from both sides of the web already in the turning section. In the turning section, a more efficient drying is achieved by overpressure nozzles than by underpressure nozzles, due to better nozzle geometry. With the over-pressure nozzles, a bigger heat transmission coefficient may be achieved than with underpressure nozzles, due e.g. to the turbulence of the air flow being discharged from them.

As the web is dried after the turning device by using airborne web-dryer units provided with exhaust air channels, it is also advantageous to discharge hot blowing air from the turning device and the counterpart through the exhaust air channels of the airborne web-dryer units. Thus moist and hot air is not led from the turning section to the machine room to increase its moisture and thermal load.

The turning device on the first side of the paper web and the airborne web-dryer unit following it may advantageously be covered with a common housing structure. Likewise, the counterpart on the opposite side of the web and the airborne web-dryer unit following it may advantageously be covered with a common housing structure.

As a summary it may be said that the following advantages are achieved with the two-sided turning device of the invention, i.e. a turning device provided with a counterpart of the invention:

- good runnability and controllability of the web, also automatically;
- reliable follow-up of the web tension;
- non-contacting travel of the web;
- higher web speed possible;
- more efficient drying possible;
- better energy economy, due to the reduction of moisture and thermal load in the machine room, as the free draws decrease and the recovery of exhaust air becomes possible, and due to the recycling of exhaust air from the airborne web-dryer to the turning device;
- saving of space, due to the better vaporization efficiency in the longitudinal direction of the web, because it is possible to maintain the performance characteristics typical of the airborne web-dryer in the counterpart, e.g. blowing speed 40–80 m/s, temperature 200–400° C., and vaporization 60–180 kg/m$^2$h.

BRIEF DESCRIPTION OF THE DRAWINGS

The invention is next described in more detail referring to the enclosed drawings in which.

DETAILED DESCRIPTION OF PREFERRED EMBODIMENTS

Figure 1:
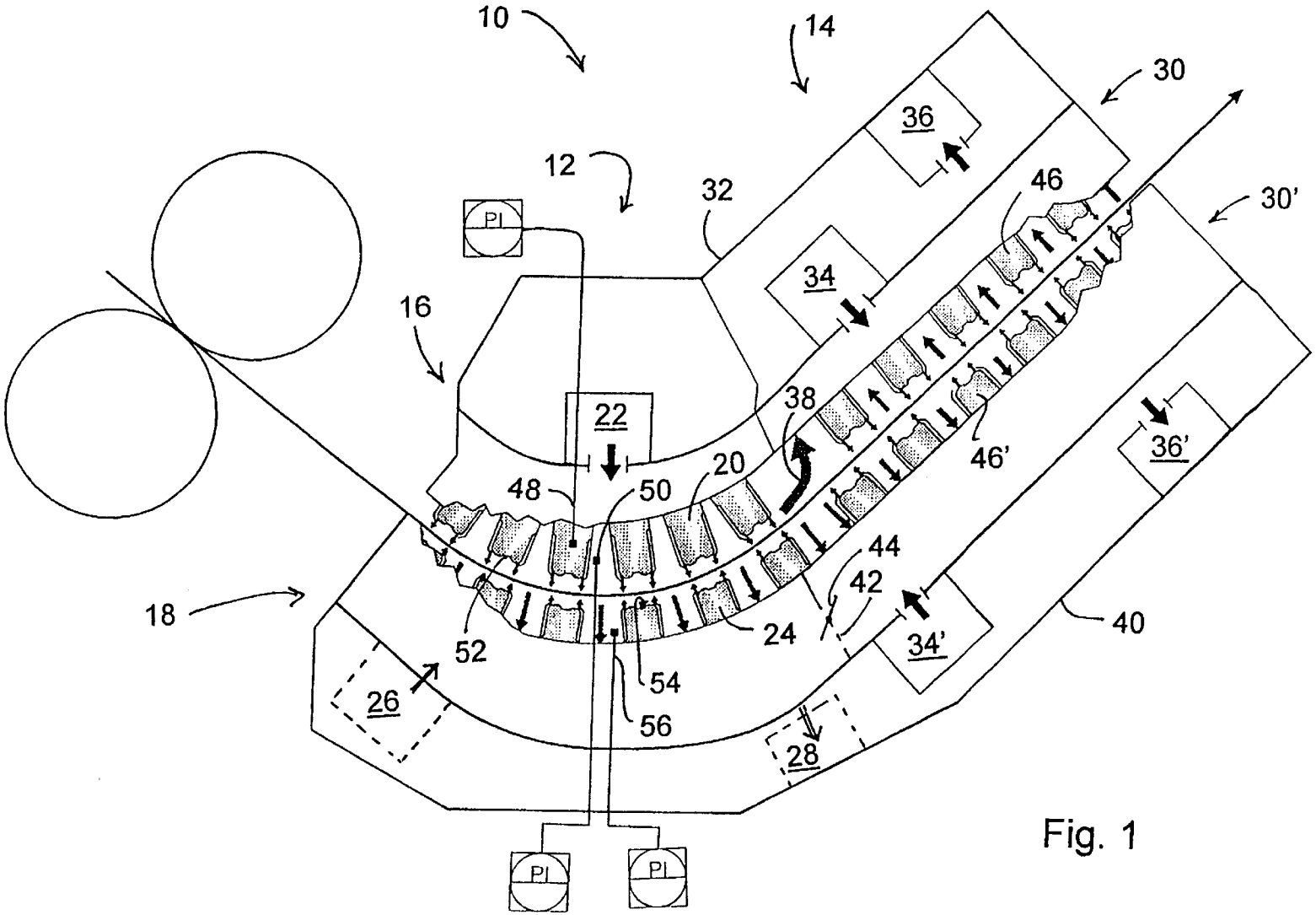
FIG. 1 is a schematic, partially vertical section of a two-sided turning device of the invention.

FIG. 1 shows a two-sided turning device 10 in accordance with the invention for drying a coated paper web W. The device comprises a device 12 turning the running direction of the paper web, and a drying apparatus 14 arranged in the running direction of the web after the web turning device.

The turning device comprises the actual turning device 16 on the first side of the web, in the case shown in the Figure above the web, and a counterpart 18 for this device on the second side of the web. The turning device 16 comprises six blow nozzles 20 which, in the case of the Figure, are overpressure nozzles of the so-called Float type of the applicant. The Float nozzles are symmetrical nozzles, from the longitudinal slots on both edges transverse to the web of the carrier surface of which blows are directed against each other and against the web, forming an overpressure zone between the nozzle and the web, and turning the running direction of the web about 70–80 degrees, in the case shown in the Figure. The turning device 16 of the Figure has its own air system with air supply channels 22 for bringing make-up air to the turning device. In the turning device, air in the machine room, exhaust air from the airborne web-dryer, circulating air, or a mixture of these, for example, may be used as blowing air.

The counterpart 18 has likewise six overpressure nozzles 24 arranged on the second side of the web exactly opposite to the nozzles 20 of the turning device. The counterpart may have an air supply system of its own with air supply channels 26, as is shown in broken lines in FIG. 1. The counterpart may also have its own exhaust or return air system with exhaust air channels 28, into which air blown against the web is absorbed, as is also shown in broken lines in FIG. 1. However, the supply and discharge of air in the counterpart may advantageously be arranged through the drying apparatus, as is explained below.

The drying apparatus 14 is an airborne web-dryer with separate airborne web-dryers or airborne web-dryer units 30 and 30' on both sides of the web. The upper airborne web-dryer unit 30 is combined with the turning device 16 under the same housing structure 32. However, the turning device is separated from the airborne web-dryer unit by a partition 39. The said airborne web-dryer unit 30 above the web has its own air supply system with air supply channels 34. The airborne web-dryer unit 30 also has its own exhaust air system with exhaust air channels 36. From the turning device 16, air is transferred along with the web to the upper airborne web-dryer unit, as is in an exemplary way shown with arrow 38, and from there onwards into the exhaust air channel 36. The necessary amount of make-up air is brought to the turning device.

The lower airborne web-dryer unit 30' is connected in a similar way to the counterpart 18 with a common housing structure 40. Exhaust air from the counterpart is arranged to flow into the exhaust air channel 36' of the airborne web-dryer unit 30'. Supply air, i.e. pressurized blowing air is led to the counterpart through the air supply channel 34' of the airborne web-dryer unit 30'. The supply air systems for the airborne web-dryer 30' and the counterpart 18, as well as the exhaust air systems, may be separated from each other by a partition 42 restricting the flow, which is provided with an adjustable damper 44 or a similar element, as is shown in broken lines in FIG. 1, with which the supply of air of the counterpart may be adjusted separately from the air flows of the airborne web-dryer unit.

In the airborne web-dryer units 30, 30', the floating or blow nozzles 46 and 46' are interlaced so that the web runs in a sine-wave form through the straight airborne web-dryer section.

FIG. 1 also indicates the pressure measurements for the control system of the turning device. The pressure sensor 48 arranged into the blow nozzle 20 of the actual turning device 16 measures the nozzle pressure $P_{SP}$ of the nozzle. The pressure sensor 50 arranged between the nozzles 20 of the turning device measures the pad pressure $P_{KL}$ of the turning device.

The pressure sensor 56 arranged between the nozzles 24 of the counterpart may respectively be used for measuring the possible underpressure or overpressure $P_{VK}$ in the counterpart.

In FIG. 1, the small arrows indicate how the blows from the nozzles 20 and 24 arranged on both sides of the web blow against each other, forming a local overpressure between the nozzle carrier surfaces 52 and 54 and the paper web on both sides of the web. These local overpressures have a stabilizing effect on the paper web and improve the runnability and controllability of the web.

Figure 3:
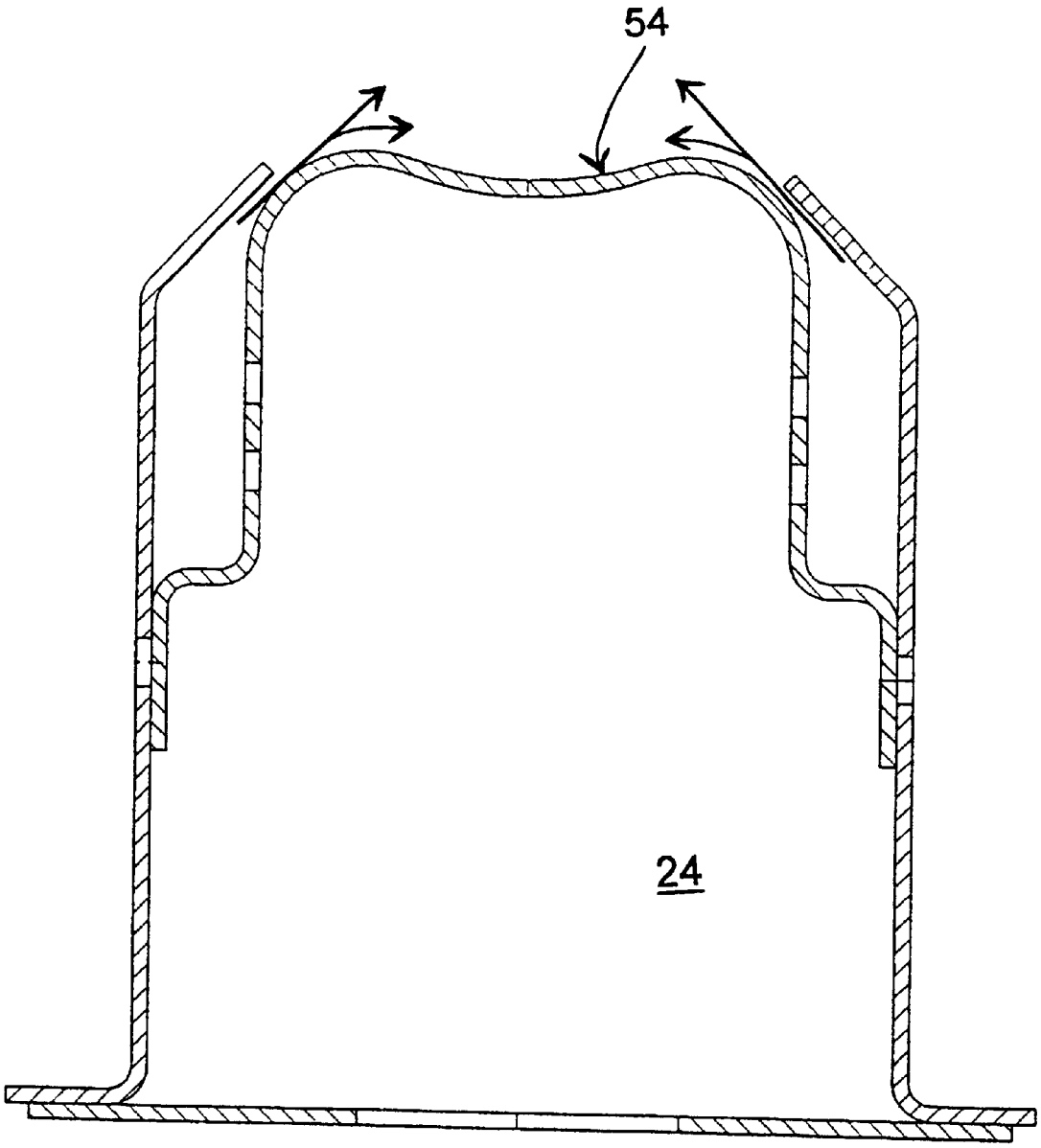
FIG. 3 is a schematic, enlarged view of an overpressure nozzle used in the counterpart of the invention.

FIG. 3 shows an enlargement of an overpressure nozzle 24 of the U.S. Pat. No. 4,384,666 used in a counterpart of the invention. The arrows indicate the direction of the blows from the carrier surface 54 towards the web.

Figure 2:
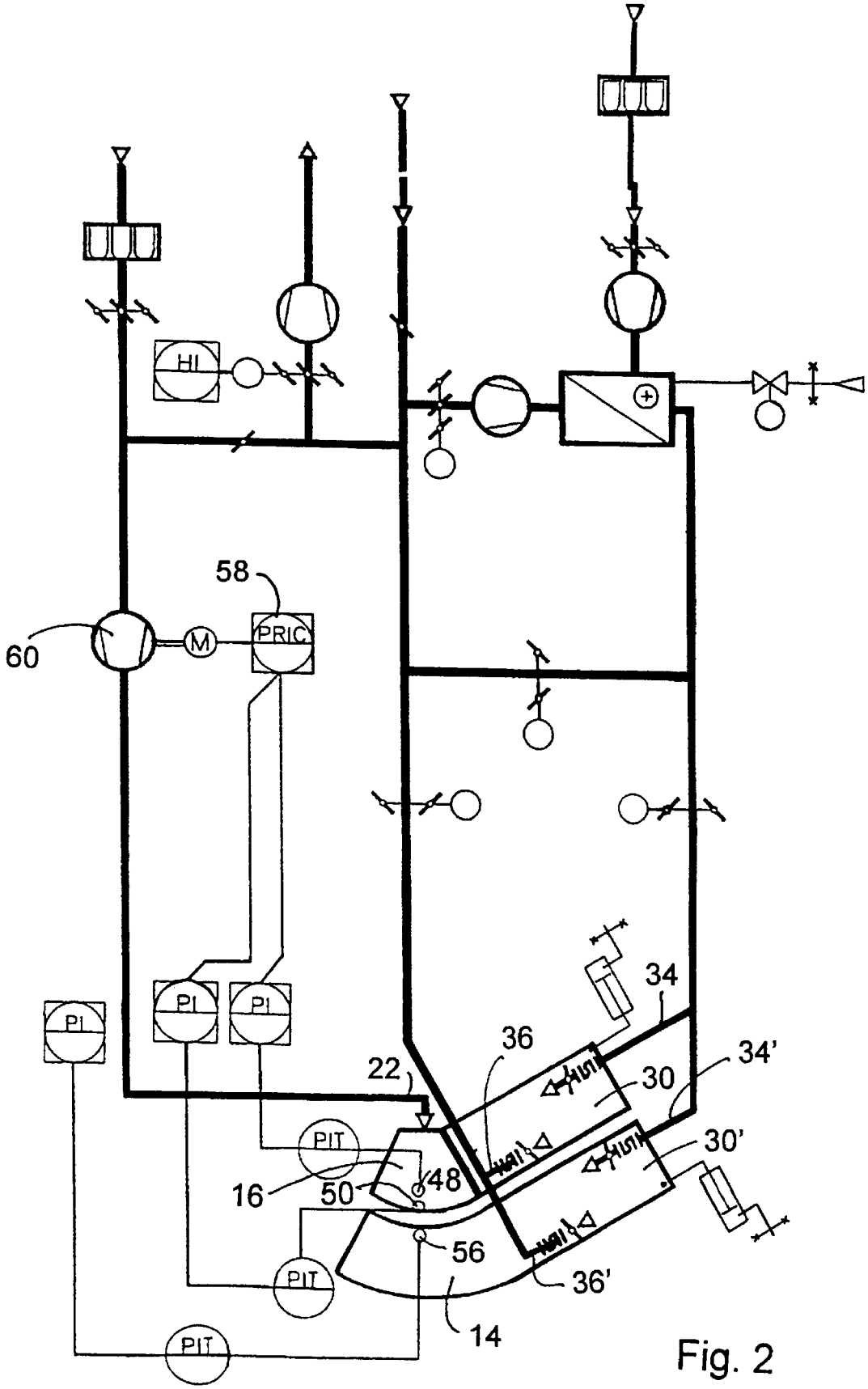
FIG. 2 is a schematic view of a control system of the two-sided turning device of FIG. 1.

The control system for a two-sided turning device in accordance with the invention is shown in more detail in FIG. 2. It may be seen from FIG. 2, that the measuring results from the differential pressure instruments 48 and 50 are led to the control device 58 with which it is possible to control the blower 60 feeding air into the air supply channel 22 of the turning device 16.

Also the air supply channels 34 and 34' and exhaust air channels 36 and 36' in the airborne web-dryer units 30 and 30' may be seen in the Figure. FIG. 2 shows the alternative in which both the supply air and the exhaust air arrangement of the counterpart are connected to the airborne web-dryer unit 30'.

The invention is above described in an exemplary way, referring mainly to one embodiment. The purpose is by no means to restrict the invention to this embodiment only, but the invention is intended to be widely applied within the scope of protection defined by the enclosed claims.

What is claimed is:

1. A method for drying a coated paper web in a device including, in a running direction of the web, a web turning device arranged on a first side of the web and provided with blow nozzles, a counterpart arranged on a second side of the web in an area of the turning device, and web drying devices arranged on the first and second sides of the web, the method comprising:

(a) turning the running direction of the web in a non-contacting way by blows generated by the blow nozzles;

(b) generating blows in an area of the turning device on the second side of the web with overpressure nozzles of the counterpart, thereby directing a pushing force against the web, pushing the web; and (c) thereafter drying the web in a non-contacting way with the web drying devices.

2. A method according to claim 1, wherein step (b) is practiced by directing the blows in the area of the turning device on the second side of the web against the blow nozzles of the turning device arranged on the first side of the web.

3. A method according to claim 1, wherein the overpressure nozzles are used for blowing hot air, the temperature of which is 150–400° C., and the speed of which is 40–80 m/s.

4. A method according to claim 1, wherein the overpressure nozzles are used for blowing hot air, the temperature of which is 100–450° C., and the speed of which is 20–100 m/s.

5. A method according to claim 1, further comprising controlling a distance H between a nozzle surface of the blow nozzles of the turning device and the web by adjusting an internal pressure $P_{SP}$ of the blow nozzles of the turning device and a pad pressure $P_{KL}$ between the turning device and the web in accordance with the following formula:

$$H = a\frac{P_{SP}}{P_{KL}} + b$$

in which

H is the distance (mm) between the nozzle surface and the web;

$P_{SP}$ is the internal pressure (Pa) of the blow nozzles;

$P_{KL}$ is the pad pressure (Pa) between the turning device and the web;

a is an amplification coefficient for the machine;

b is a difference variable for the machine.

6. A method according to claim 1, further comprising adjusting a web tension T by utilizing pad pressure $P_{KL}$ between the turning device and the web, and a pressure $P_{VK}$ between the counterpart and the web, in accordance with the following formula:

$$T=C^*[P_{KL}(r+h)-k_{VK}P_{VK}(r+h)+Mv^2]$$

in which

C is an amplification coefficient relating to the machine in question within a range of 0.7–1.4;

r is a radius (m) of the turning device;

h is a distance (m) between the turning device and the paper web;

T is the tension (N/m) of the paper web;

M is a grammage (kg/m$^2$) of the paper web;

v is a speed (m/s) of the paper web;

$P_{KL}$ is the pad pressure (Pa) between the turning device and the web;

$P_{VK}$ is the pressure (Pa) between the counterpart and the web;

$k_{VK}$ is a parameter constant within a range of 0.6–1.

7. A method according to claim 6, wherein the amplification coefficient C is 1.0, and wherein the parameter $k_{VK}$ is 0.8.

8. A method according to claim 1, wherein the drying devices include airborne drying units provided with exhaust air channels and arranged on the first and second sides of the web, the method further comprising absorbing at least one of blowing air from the blow nozzles of the turning device and blowing air from the overpressure nozzles of the counterpart into the exhaust air channels of the airborne web drying units.

9. A method according to claim 1, further comprising discharging air from the turning device primarily into the web drying devices arranged after the turning device.

10. A method according to claim 1, wherein step (a) is practiced by controlling the web run by adjusting a pressure prevailing in the counterpart.

11. An apparatus for drying a coated paper web comprising, in a running direction of the web:

a web turning device arranged on a first side of the web and provided with blow nozzles, the blow nozzles generating blows that turn the running direction of the web to be dried in a non-contacting way;

a counterpart arranged on a second side of the web in an area of the turning device, the counterpart including overpressure nozzles arranged on the second side of the web, the overpressure nozzles producing blows that generate a pushing force on the second side of the web, pushing the web; and web drying devices arranged on the first and second sides of the web, the web drying devices including floating nozzles for non-contacting drying of the web.

12. An apparatus according to claim 11, wherein at least one of the blow nozzles and the overpressure nozzles are symmetrical overpressure nozzles with air flow from slots on both edges from carrier surfaces of the nozzles against each other, thus forming an overpressure zone between the nozzles and the web.

13. An apparatus according to claim 11, wherein the web drying devices are airborne web-dryer units arranged on the first and second side of the web and provided with exhaust air channels for discharging blowing air from a space between the floating nozzles and the web, wherein a space between the turning device and the web is in contact with the exhaust air channel of the airborne web-dryer units on the first side of the web for discharging blowing air from the turning device, and wherein a space between the counterpart and the web is in contact with the exhaust air channel of the airborne web-dryer units on the second side of the web for discharging air blown toward the web by the overpressure nozzles of the counterpart.

14. An apparatus according to claim 11, wherein the blow nozzles of the turning device are provided with a first pressure sensor for measuring an internal pressure $P_{SP}$ of the blow nozzle, and wherein the turning device is provided with a second pressure sensor for measuring a pad pressure $P_{KL}$ between the turning device and the web, the apparatus further comprising control elements for calculating a distance H between the nozzle surface of the turning device and the web and for adjusting the distance to a desired level on the basis of values from the pressure sensors, in accordance with the following formula:

$$H = a\frac{P_{SP}}{P_{KL}} + b$$

in which

H is the distance (mm) between the nozzle surface and the paper web;

$P_{SP}$ is the internal pressure (Pa) of the blow nozzles;

$P_{KL}$ is the pad pressure (Pa) between the turning device and the web;

a is an amplification coefficient for the apparatus;

b is a difference variable for the apparatus.

15. An apparatus according to claim 14, further comprising an air channel and a blower that direct air into the blow nozzles of the turning device the control elements comprising elements for controlling an amount of air to be fed into the blow nozzles.

16. An apparatus according to claim 11, wherein the turning device is provided with a first pressure sensor for measuring a pad pressure $P_{KL}$ between the turning device and the web, and wherein the counterpart is provided with a second pressure sensor for measuring a pressure $P_{VK}$ between the counterpart and the web, the apparatus further comprising control elements for adjusting a tension T of the web on the basis of values from the pressure sensors, in accordance with the following formula:

$$T=C^*[P_{KL}(r+h)-k_{VK}P_{VK}(r+h)+Mv^2]$$

in which r is a radius (m) of the turning device;

h is a distance (m) between the turning device and the paper web;

T is the tension (N/m) of the paper web;

M is a grammage (kg/m$^2$) of the paper web;

v is a speed (m/s) of the paper web;

$P_{KL}$ is the pad pressure (Pa) between the turning device and the web;

$P_{VK}$ is the pressure (Pa) between the counterpart and the web;

$k_{VK}$ is a parameter constant within a range of 0.6–1.

17. An apparatus according to claim 16, wherein the parameter $k_{VK}$ is 0.8.

18. An apparatus according to claim 11, further comprising a housing structure covering a part of the counterpart facing away from the web, the housing structure comprising an exhaust air channel that absorbs air blown towards the paper web from a space between the web and the overpressure nozzles.

19. An apparatus according to claim 11, further comprising a common housing structure covering the web drying devices arranged on the second side of the web the housing structure including an exhaust air channel that absorbs drying air and air blown through the overpressure nozzles in the counterpart.

20. An apparatus according to claim 11, wherein the turning device comprises 3–15 blow nozzles arranged facing the first side of the web and wherein the counterpart comprises 3–15 overpressure nozzles arranged facing the second side of the web, a majority of the overpressure nozzles being arranged to blow towards the web to points on the second side of the web corresponding to points on the first side of the web at which the blow nozzles are facing.

21. An apparatus according to claim 11, further comprising a housing structure covering the turning device and the web drying devices arranged adjacent and wherein a partition is provided between the turning device and the web driving devices for maintaining pad pressure in the turning device.

* * * * *